US006579125B1

(12) United States Patent
Nagahata et al.

(10) Patent No.: US 6,579,125 B1
(45) Date of Patent: Jun. 17, 2003

(54) CLIP CONNECTOR, METHOD OF ATTACHING CLIP CONNECTOR, AND ASSEMBLY OF CLIP CONNECTOR AND SUPPORT MEMBER

(75) Inventors: Takaya Nagahata, Kyoto (JP); Koji Nishi, Kyoto (JP); Shigeyoshi Ono, Kyoto (JP); Yasuhiro Yoshikawa, Kyoto (JP); Yoshinobu Kishimoto, Kyoto (JP); Koichi Wada, Yamagata (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/857,686

(22) PCT Filed: Dec. 6, 1999

(86) PCT No.: PCT/JP99/06835

§ 371 (c)(1),
(2), (4) Date: Jun. 8, 2001

(87) PCT Pub. No.: WO00/35052

PCT Pub. Date: Jun. 15, 2000

(30) Foreign Application Priority Data

Dec. 10, 1998 (JP) ..... 10/351597

(51) Int. Cl.[7] ..... H01R 24/00

(52) U.S. Cl. ..... 439/629; 439/65; 439/936; 439/876

(58) Field of Search ..... 439/629, 936, 439/65, 78, 876

(56) References Cited

U.S. PATENT DOCUMENTS

| | | | | |
|---|---|---|---|---|
| 3,479,634 A | * | 11/1969 | Pritulsky | 439/560 |
| 3,697,926 A | * | 10/1972 | Krafthefer | 439/629 |
| 3,706,954 A | * | 12/1972 | Krafthefer | 439/65 |
| 5,049,435 A | * | 9/1991 | Uno et al. | 428/209 |
| 5,907,347 A | | 5/1999 | Nagahata et al. | 347/208 |

FOREIGN PATENT DOCUMENTS

| | | |
|---|---|---|
| JP | 4-51781 | 4/1992 |
| JP | 08-037048 | 6/1996 |
| JP | 9-45438 | 2/1997 |
| JP | 10-334968 | 12/1998 |

* cited by examiner

*Primary Examiner*—Javaid Nasri
(74) *Attorney, Agent, or Firm*—Michael D. Bednarek; Shaw Pittman LLP

(57) ABSTRACT

A clip connector (A) includes an insulating housing (1) and a plurality of terminals (2) projecting from the housing (1). The housing (1) includes an outer surface (1*a*) for engaging a support member such as a printed board. The outer surface (1*a*) is irregular, including a plurality of projecting portions (12) and a plurality of retreating portions (13). Each of the terminals (2) includes a straight portion (20*a*) and a bent portion (20*b*). Each of the straight portion (20*a*) is formed with a through-hole (22) through which a resin for bonding the support member and the outer surface (1*a*) is applied.

9 Claims, 5 Drawing Sheets

CLIP CONNECTOR, METHOD OF ATTACHING CLIP CONNECTOR, AND ASSEMBLY OF CLIP CONNECTOR AND SUPPORT MEMBER

TECHNICAL FIELD

The present invention relates to a connector for electrically connecting a part with another. The present invention particularly relates to a clip connector which is capable of clamping an edge of a printed board or the like. Further, the present invention relates to a method of attaching a clip connector to a support member such as a printed board, and also to an assembly of a clip connector and a support member.

BACKGROUND ART

An example of prior-art clip connector is shown in FIG. 8. The illustrated clip connector B includes a housing 90 made of a synthetic resin, and a plurality of terminals 91 (only one is shown in this figure) which are formed of metal and carried by the housing. Each of the terminals 91 includes an outer portion 91*a* extending outward from the housing 90. The outer portion 91*a* is bent as shown in this figure for clamping a printed board 92. In clamping the printed board 92, the outer portion 91*a* comes into contact with a connection pad 93 formed on the printed board 92.

The clip connector B can be attached to the printed board 92 owing to the above-described clipping function of the outer portion 91*a*. However, with such an attachment, the outer portion 91*a* cannot be insulated and protected. Further the outer portion 91*a* is likely to be easily detached from the printed board 92. To eliminate these problems, the outer portion 91*a* and nearby portions are coated with an insulating resin 94.

Although the clip connector B having the above-described structure is convenient for electrically connecting two devices, it also has the following problems.

Firstly, the process for coating the outer portion 91*a* and the adjacent portion thereof with the resin 94 is troublesome. This is because, for appropriately coating the outer portion 91*a* and the adjacent portion thereof with the resin 94, it is necessary to apply the resin 94 not only to an obverse portion Na but also to a reverse portion Nb of the printed board 92. (Herein, it should be noted that it is difficult to apply the resin 94 to the reverse portion Nb from the obverse side of the printed board 92. Thus, the resin 94 needs to be applied to the reverse portion Nb with the printed board 92 tuned over.)

Secondly, as will be easily understood from FIG. 8, when the clip connector B is attached to the printed board 92, the housing 90 of the clip connector B largely projects laterally from the printed board 92 (See a reference sign L). This is not advantageous for reducing the size of an assembly utilizing the clip connector B.

The third problem derives from the fact that the distance between points P indicated in this figure and the housing 90 is relatively long. That is, with such a structure, even by a relatively small moment M exerted on the housing 90, the clip connector B may be deviated relative to the printed board 92. As a result, proper conduction between the outer portion 91*a* and the pad 93 may be broken.

DISCLOSURE OF THE INVENTION

An object of the present invention, which has been conceived under the circumstances described above, is to provide a clip connector which can be easily and reliably attached to a support member such as a printed board without becoming disadvantageously bulky.

In accordance with a first aspect of the present invention, there is provided a clip connector for attachment to a support member. The connector comprises a housing having an outer surface for engagement with the support member, and at least one terminal projecting from the housing. The terminal is so arranged that the support member is clamped between the terminal and the outer surface.

With such a structure, the support member contacts not only the terminal but also the outer surface of the housing. Therefore, it is possible to stably attach the clip connector to the support member. The support member may be a printed board for example.

Preferably, the outer surface of the housing may be irregular. Such a configuration may be provided by forming, on the outer surface of the housing, at least one projecting portion and at least one retreating portion.

Preferably, the terminal projects from the retreating portion.

Preferably, the terminal includes a straight portion projecting from the housing, and a bent portion connected to the straight portion for engagement with the support member.

Preferably, the straight portion of the terminal may be formed with a through-hole which is open toward the support member.

Preferably, the through-hole may be partially embedded in the housing.

In accordance with a second aspect of the present invention, there is provided a method of attaching a clip connector to a support member, the clip connector including a housing having an engaging surface and at least one terminal projecting from the housing. The method comprises a first step of inserting the support member between the engaging surface of the housing and the terminal, a second step of applying fluid resin for covering the terminal, and a third step of allowing the resin to harden. In the second step, part of the resin is allowed to enter a gap defined between the engaging surface and the support member.

With such a structure, the engaging surface of the housing is strongly bonded to the support member by the resin entering the gap. By allowing the resin to enter the gap, it is possible to apply the resin also to the reverse surface of the support member without turning over the support member.

Preferably, at least one of the engaging surface of the housing and the support member may be irregular.

Preferably, the terminal may be formed with a through-hole for allowing passage therethrough of the resin applied.

Preferably, the resin maybe an ultraviolet-setting resin. The resin entering the gap is hardened by ultraviolet irradiation via the through-hole.

In accordance with a third aspect of the present invention, there is provided an assembly of a clip connector and a support member. The clip connector includes a housing having an engaging surface and at least one terminal projecting from the housing. The support member is clamped between the engaging surface of the housing and the terminal. The support member and the engaging surface defines therebetween a gap into which a resin is applied.

Other features and advantages of the present invention will become clearer from the detailed description of preferred embodiments given below with reference to the accompanying drawings.

BEST MODE FOR CARRYING OUT THE INVENTION

Preferred embodiments of the present invention will be described below with reference to the accompanying drawings.

Figure 1:
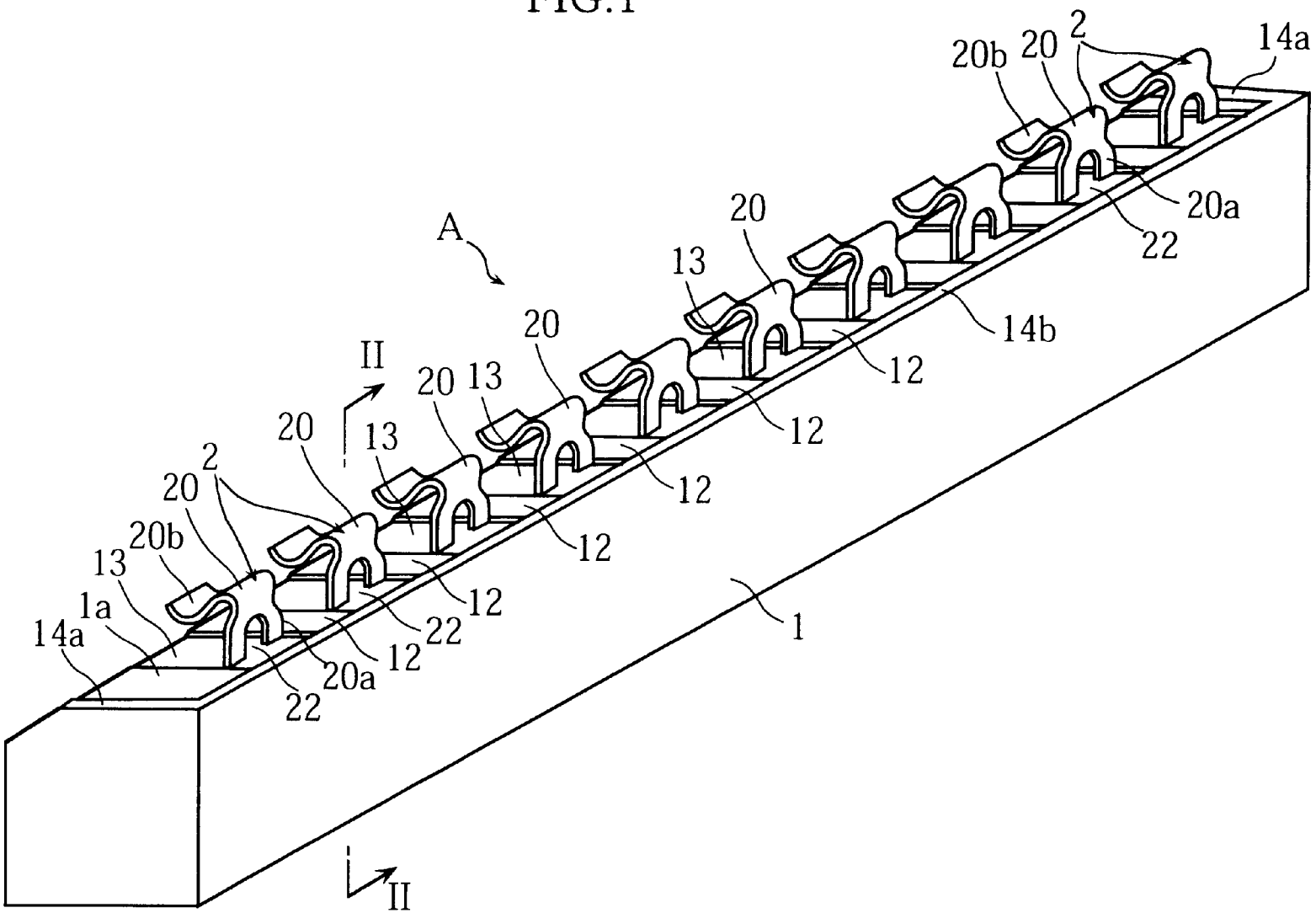
FIG. 1 is a perspective view showing an example of clip connector in accordance with the present invention.
Figure 2:
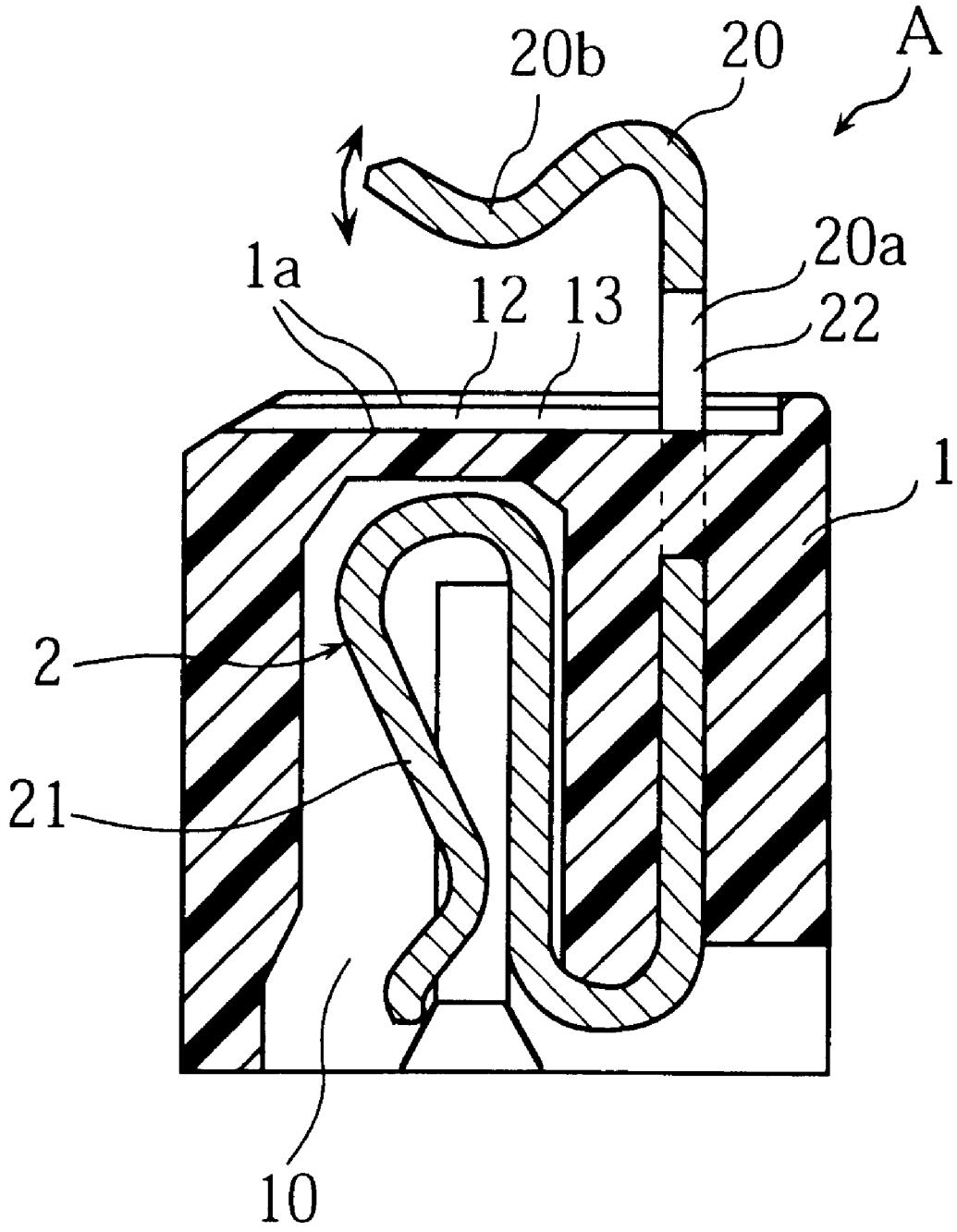
FIG. 2 is a sectional view taken along lines II—II in FIG. 1.

Reference is first made to FIGS. 1 and 2, which illustrate a clip connector (reference sign A) in accordance with a first embodiment of the present invention. The clip connector A includes a housing 1 formed of an insulating synthetic resin and a plurality of terminals 2 formed of a conductive metal and fixed to the housing.

The housing 1 is formed by molding (insert molding) in such a manner as to embed a portion of each terminal 2 in the resin material. As shown in FIG. 1, the housing 1 has an elongated, generally rectangular configuration. The plurality of terminals 2 are arranged at a predetermined pitch longitudinally of the housing 1. As shown in FIG. 2, each of the terminals 2 includes an outer portion 20 and an inner portion 21. The inner portion 21 is provided for electrical contact with a corresponding terminal of another connector which is used in pair with the clip connector A. The inner portion 21 forms an elastically deformable clip. The housing 1 is formed with a plurality of hollow portions 10 provided correspondingly to the terminals 2. Each of the hollow portions 10, which is downwardly open, receives the corresponding inner portion 21.

As shown in FIG. 2, the outer portion 20 of each terminal 2 projects from an upper surface 1*a* of the housing 1. Specifically, the outer portion 20 includes a straight portion 20*a* extending perpendicularly to the upper surface 1*a*, and a bent portion 20*b* connected to the straight portion 20*a*. The bent portion 20*b* faces the upper surface 1*a* of the housing 1 as appropriately spaced therefrom, and is elastically deformable in the directions indicated by the arrow in FIG. 2. With such a structure, it is possible to clamp a print board for example having a predetermined thickness between the bent portion 20*b* and the upper surface 1*a*.

As shown in FIGS. 1 and 2, the straight portion 20*a* of each terminal 2 is formed with a through-hole 22. The through-hole 22 faces a support member 3 (See FIG. 3). As is clear from FIG. 2, the through-hole 22 is partially embedded in the housing 1. The technical significance of the through-hole 22 will be described later.

As shown in FIG. 1, the upper surface 1*a* of the housing 1 is not flat. Specifically, the upper surface 1*a* comprises a plurality of projecting portions 12 located at a higher position, and a plurality of retreating portions 13 located at a lower position. The projecting portions 12 and the retreating portions 13 are alternately arranged. Thus, each retreating portion 13 is arranged between two adjacent projecting portions. The outer portion 20 of each terminal 2 projects upward from the corresponding retreating portion 13.

The housing 1 includes two first edges 14*a* and one second edge 14*b* adjoining to the upper surface 1*a*. The second edge 14*b* extends longitudinally of the housing 1, whereas the first edges 14*a* extend perpendicularly to the second edge 14*b*. The first and the second edges are flush with each other and located higher than the projecting portions 12.

Figure 3:
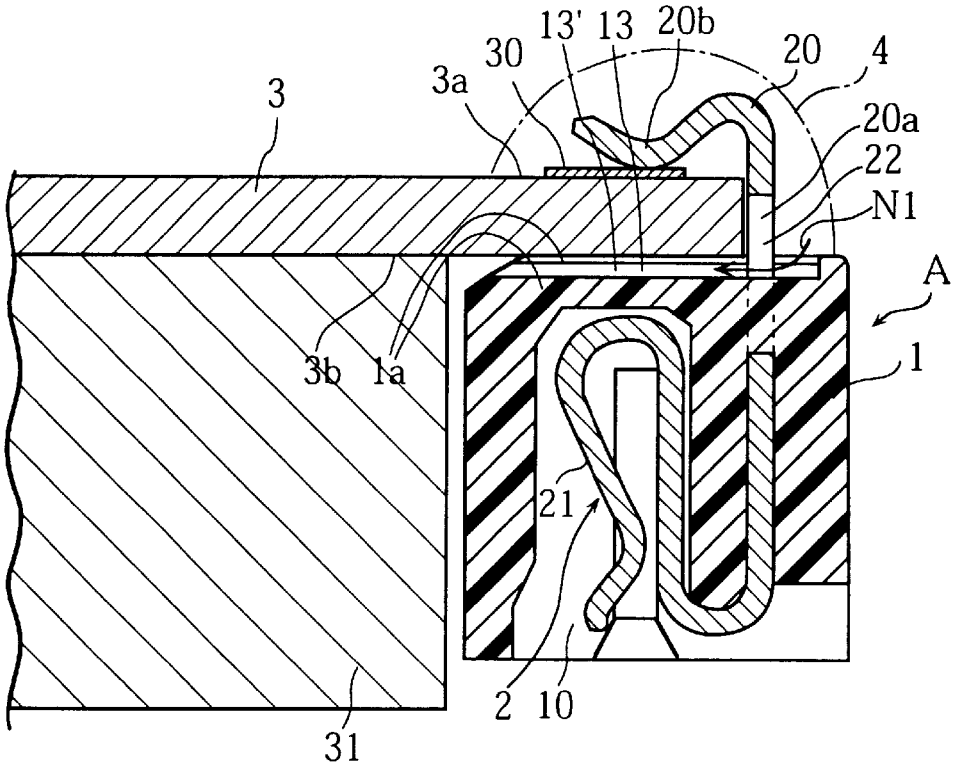
FIG. 3 is a sectional view showing a step of attaching the clip connector shown in FIG. 1 to a printed board.
Figure 4:
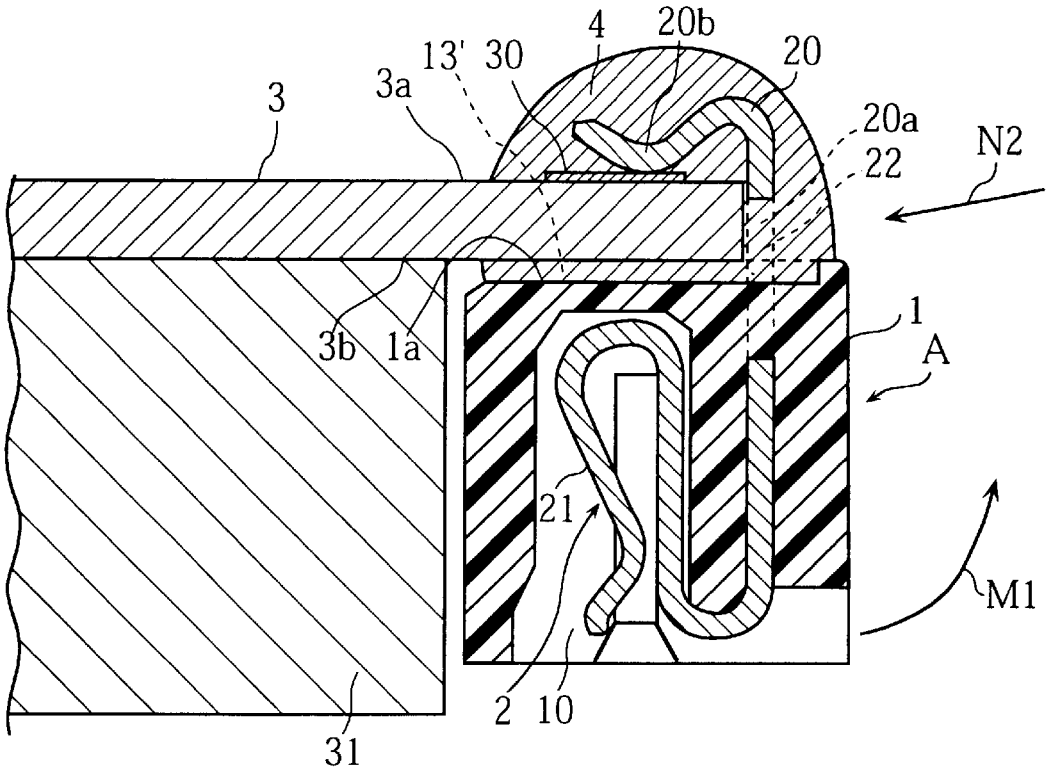
FIG. 4 is a sectional view showing the clip connector attached to the printed board.

Next, reference is made to FIGS. 3 and 4. These figures illustrate an example of method of fixing the above-described clip connector A to a support member 3. The illustrated support member 3 is a printed board for a thermal printhead having a surface on which a plurality of heating elements and a plurality of drive ICs (both of which are not shown) are mounted. The print board 3 has a reverse surface 3*b* on which is bonded a heat sink plate 31 for absorbing heat generated at the heating elements.

As shown in FIG. 3, for attaching the clip connector A to the board 3, an edge of the substrate 3 is clamped between the bent portion 20*b* of each terminal 2 and the upper surface 1*a* of the housing 1. In this state, the bent portion 20*b* partially comes into electrical contact with a respective pad 30 provided on the obverse surface 3*a* of the board 3.

As previously described, the upper surface 1*a* is irregular. Therefore, in the state shown in FIG. 3, a gap 13' is defined between the upper surface 1*a* and the reverse surface 3*b* of the board 3. The gap 13' is partially defined by the retreating portions 13. Each retreating portion 13 is not entirely covered by the board 3, but exposed at a portion adjacent the second edge 14*b* of the housing 1.

As indicated by phantom lines in FIG. 3, after the connector A is attached to the printed board 3 utilizing the bent portion 20*b* of each terminal, a fluid resin 4 is applied to cover the outer portion 20 of the terminal 2 and nearby portions. The resin 4 may be an ultraviolet-setting epoxy resin for example. As indicated by an arrow N1, the resin 4 thus applied flows partially into the gap 13'. Therefore, it is not necessary to further apply resin onto the reverse surface 3*b* of the printed board 3. By lowering the viscosity of the resin 4, it is possible to spread the resin entirely over the gap 13' in a relatively short period of time due to capillary action. At this time, the through-hole 22 of the outer portion 20 serves as a passage for flow of the resin 4.

Then, the resin 4 is subjected to ultraviolet irradiation for hardening. As indicated by an arrow N2 in FIG. 4, ultraviolet rays are directed toward the through-hole 22 of the outer portion 20 for hardening the resin 4 within the gap 13'. Thus, it is possible to make the ultraviolet rays to propagate through the through-hole 22 into the gap 13'. By thus hardening the resin 4, the outer portion 20 of the terminal 2 and the pad 30 in conduction therewith are insulated and protected. Further, the hardened resin 4 provides bonding between the outer portion 20 and the board 3 as well as between the upper surface 1*a* of the housing 1 and the reverse surface 3*b* of the board 3. Moreover, by filling the resin into the through-hole 22, it is possible to provide a reliable adhesion between the hardened resin 4 and the terminal 2.

In accordance with the first embodiment of the present invention, most portion of the housing 1 of the clip connector A is arranged directly under the printed board 3, as shown in FIG. 4. Thus, it is possible to prevent the housing 1 from laterally projecting outward from the printed board 3. This structure is advantageous in arranging another device beside the printed board 3. Further, the clip connector A is attached to the board 3 with the upper portion of the housing 1 held in contact with the board 3. With such a structure, the terminal 2 contacts the board 3 at a position close to the housing 1. Therefore, as shown in FIG. 4, even if a moment M1 is exerted to the housing 1, the clip connector A is unlikely to be detached from the print board 3 or deviated relative to the print board 3. Particularly because the upper surface 1*a* of the housing 1 is bonded to the reverse surface 3*b* of the board 3 by the resin 4 entering the gap 13', the strength of attachment of the clip connector A to the board 3 can be enhanced. As a result, it is possible to appropriately keep the electric contact between the pad 30 of the board 3 and the outer portion 30.

Moreover, with the structure shown in FIG. 4, the resin 4 entering the gap 13' need not extend laterally beyond the housing 1. Therefore, the heat sink plate 31 may be disposed considerably close to the side wall of he housing 1, thereby making it possible to increase the size of the heat sink plate 31 as much.

In the above-described first embodiment, the resin 4 is an ultraviolet-setting resin. Instead, a thermosetting resin may be employed. Alternatively, use may be made of a resin which hardens by natural cooling.

Figure 5:
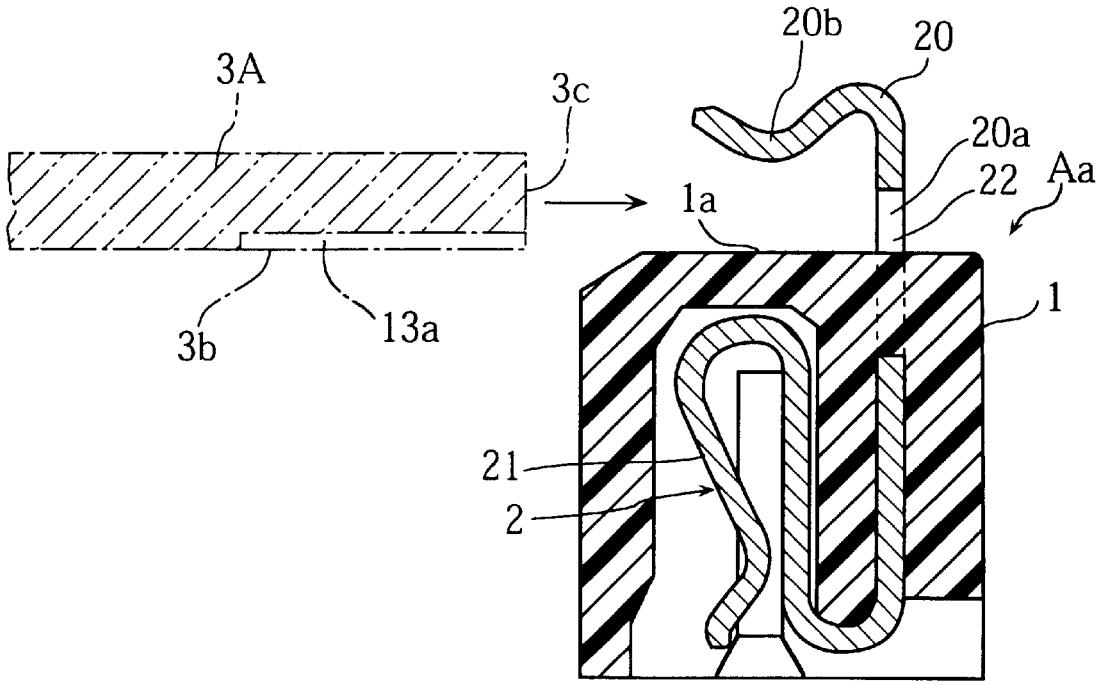
FIG. 5 is a sectional view another example of clip connector in accordance with the present invention.

FIG. 5 is a sectional view showing a clip connector (reference sign Aa) in accordance with a second embodiment of the present invention. The clip connector Aa is substantially the same in structure as the clip connector A according to the first embodiment except that an upper surface 1*a* of a housing 1 is a flat surface.

Figure 6:
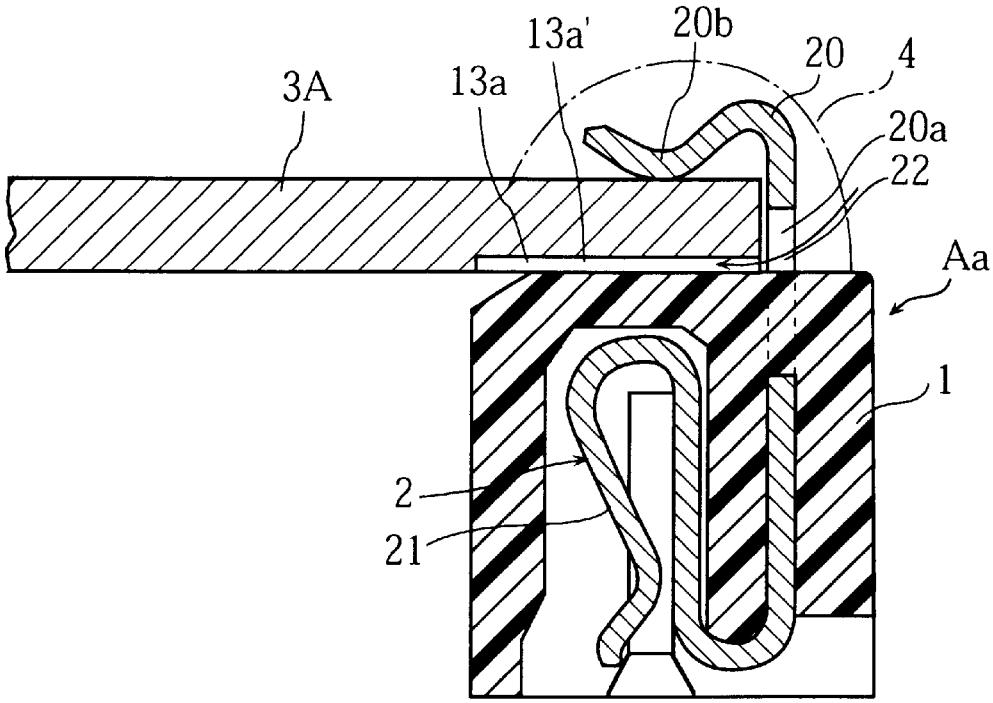
FIG. 6 is a sectional view showing a step of attaching the clip connector shown in FIG. 5 to a printed board.

As shown in FIGS. 5 and 6, for attaching the clip connector Aa to a board 3A, a reverse surface 3*b* of the board 3A is made irregular in advance. Specifically, at least one retreating portion or groove 13*a* is formed on the reverse surface 3*b*. The retreating portion 13*a* is open at an edge surface 3*c* of the board 3A. With such a structure, when the board 3A is clamped between the upper surface 1*a* of the housing 1 and a bent portion 20*b* of each terminal 2, a gap 13*a*' is defined between the upper surface 1*a* of the housing 1 and the reverse surface 3*b* of the board 3A. Therefore, as indicated by phantom lines in FIG. 6, when resin 4 is applied to cover an outer portion 20 of each terminal 2 and an adjacent portion thereof, part of the resin 4 flows into the gap 13*a*'. Similarly to the first embodiment, the resin 4 thus applied is hardened by ultraviolet irradiation.

Figure 7:
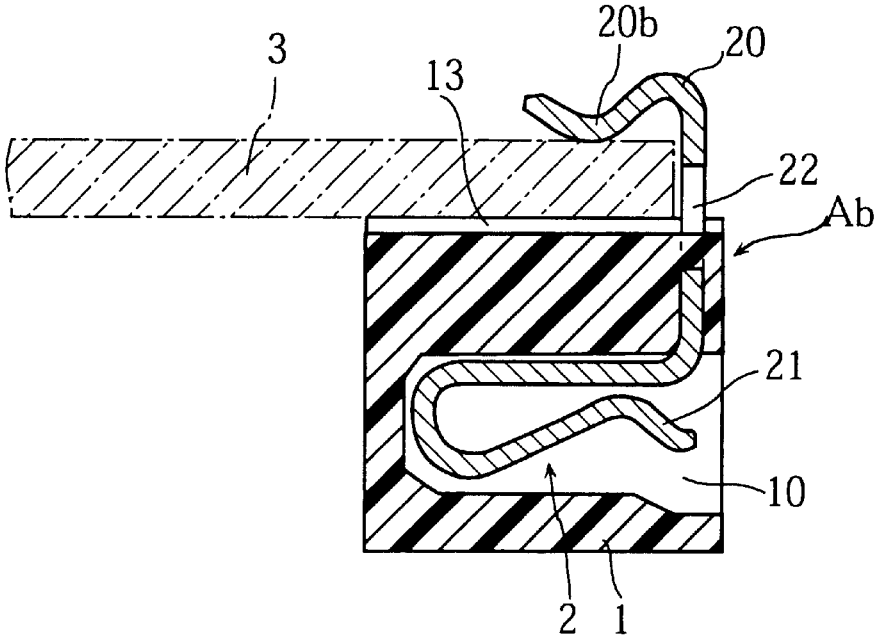
FIG. 7 is a sectional view showing another example of clip connector in accordance with the present invention.
Figure 8:
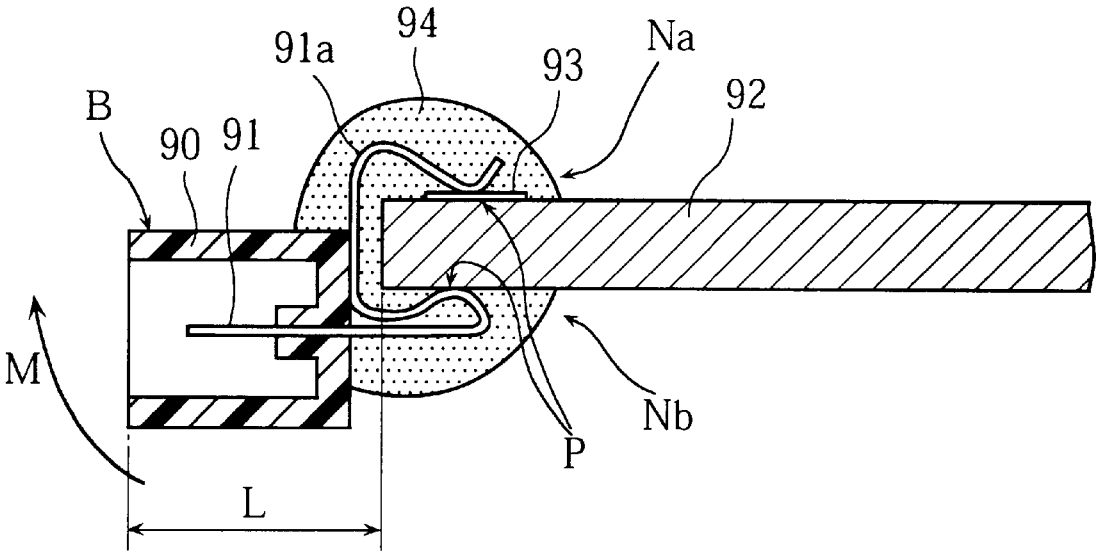
FIG.8 PRIOR ART
FIG. 8 is a sectional view showing a prior-art clip connector attached to a printed board.

FIG. 7 illustrates a clip connector (reference sign Ab) in accordance with a third embodiment of the present invention. The clip connector Ab is similar to the connector A of the first embodiment in that a housing 1 is formed with retreating portions. However, the connector Ab differs from the connector A in that the housing 1 is formed with a hollow portion 10 which is open laterally of the housing 1.

The present invention being described above, it is apparent that the same may be varied in many ways. Such variations should not be regarded as a departure from the spirit and scope of the present invention, and all such modifications as would be obvious to those skilled in the art are intended to be included within the scope of the following claims.

What is claimed is:

1. A clip connector for attachment to a support member comprising:

a housing having an outer surface for engagement with the support member, the outer surface being formed with a retreating portion; and at least one terminal projecting from the retreating portion of the outer surface;

the terminal being so arranged that the support member is clamped between the terminal and the outer surface, the terminal having a through-hole communicating with the retreating portion for allowing passage of resin into a gap between the housing and the support member.

2. The clip connector according to claim 1, wherein the terminal includes a straight portion projecting from the housing, and a bent portion connected to the straight portion for engagement with the support member.

3. The clip connector according to claim 2, wherein the through-hole is formed at the straight portion of the terminal.

4. The clip connector according to claim 1, wherein the through-hole is open toward the support member.

5. The clip connector according to claim 1, wherein part of the housing extends through the through-hole.

6. A method of attaching a clip connector to a support member, the clip connector including a housing having an engaging surface and at least one terminal projecting from the housing, the terminal being formed with a through-hole, the method comprising the steps of:

inserting the support member between the engaging surface of the housing and the terminal;

applying fluid resin for covering the terminal; and allowing the resin to harden;

wherein, in the step of applying the fluid resin, part of the resin is allowed to pass the through-hole of the terminal for entering a gap defined between the housing and the support member.

7. The method according to claim 6, wherein at least one of the engaging surface of the housing and the support member is irregular.

8. The method according to claim 6, wherein the resin is an ultraviolet-setting resin, the resin entering the gap being hardened by ultraviolet irradiation via the through-hole.

9. An assembly of a clip connector and a support member, the clip connector including a housing having an engaging surface and at least one terminal projecting from the housing, the terminal being formed with a through-hole:

the support member being clamped between the engaging surface of the housing and the terminal;

the support member and the housing defining therebetween a gap into which a resin is applied, the resin extending through the through-hole.

* * * * *